US006353978B1

(12) United States Patent
Kawahara et al.

(10) Patent No.: US 6,353,978 B1
(45) Date of Patent: Mar. 12, 2002

(54) SNAP FASTNER HAVING A DETACHMENT DIRECTIONALITY

(75) Inventors: Masahiko Kawahara, Osaka; Sadao Miyoshi, Hyogo, both of (JP)

(73) Assignee: Morito Co., Ltd. (JP)

( * ) Notice: Subject to any disclaimer, the term of this patent is extended or adjusted under 35 U.S.C. 154(b) by 0 days.

(21) Appl. No.: 09/541,494

(22) Filed: Apr. 3, 2000

(30) Foreign Application Priority Data

Apr. 28, 1999 (JP) ..... 11-121568
Jun. 17, 1999 (JP) ..... 11-170619

(51) Int. Cl.[7] ..... A44B 1/38; A44B 17/00
(52) U.S. Cl. ..... 24/114.4; 24/90.5; 24/114.05; 24/662
(58) Field of Search ..... 24/114.4, 114.5, 24/90.5, 91, 92, 324, 662

(56) References Cited

U.S. PATENT DOCUMENTS 1,604,913 A * 10/1926 Hattingberg ..... 24/662
2,895,199 A * 7/1959 Jones ..... 24/618
3,152,376 A * 10/1964 Boser et al. ..... 24/618
3,869,766 A * 3/1975 Raymond ..... 24/662
4,183,121 A 1/1980 Cousins
4,796,339 A * 1/1989 Burke ..... 24/662
5,050,279 A * 9/1991 Nemazi et al. ..... 24/662

FOREIGN PATENT DOCUMENTS

| | | |
|---|---|---|
| DE | 871 732 | 3/1953 |
| EP | 534 508 A1 | 3/1993 |
| GB | 21062 | of 1911 |
| JP | 10033210 | 2/1998 |
| WO | 83 01182 | 4/1983 |
| WO | 83 01889 | 6/1993 |

* cited by examiner

*Primary Examiner*—Victor N. Sakran
(74) *Attorney, Agent, or Firm*—Bacon & Thomas, PLLC

(57) ABSTRACT

A snap fastener having a detachment directionality. The fastener includes a portion for minimizing the gap between the male and female snaps (1, 4). The portion is, for example, a small protrusion (17) established on the side of the neck (13) opposite the engagement edge (16),or a protrusion (47) established on the side of the female snap.

3 Claims, 7 Drawing Sheets

SNAP FASTNER HAVING A DETACHMENT DIRECTIONALITY

FIELD OF THE INVENTION

The present invention relates to a snap fastener having a detachment directionality. When the male and female parts of this type of fastener are fitted to their respective cloths, the cloths can be separated from each other from a certain direction but not from other directions. This type of snap fastener has numerous applications including bags, shoes, etc.

BACKGROUND OF THE INVENTION

A prior invention by the applicant of the present invention disclosed in JP-A-10-33210(1998) is a tape-mounted snap fastener comprising a male-side tape consisting of resin male snaps mould-fastened on a cloth tape at certain intervals and a female-side tape consisting of resin female snaps mould-fastened on a cloth tape at the same intervals as the male-side tape.

The male snap has an attachment protrusion sticking out from the center of a male base, said attachment protrusion comprising a neck and an attachment head, wherein said neck is concentric with the male base while said attachment head is eccentric from the axial center of the neck to form an engagement edge.

The female snap has a female base having a head-inserting guide hole for inserting the attachment protrusion, an attachment hole through which the attachment head passes as it elastically changes its form, and a head chamber hole encasing the attachment head, wherein said head-inserting guide hole is concentric with the attachment hole while said head chamber hole is eccentric from the insertion center so as to correspond to the eccentricity of the attachment head of the male snap, and a stopper step is formed at least on the eccentric side of the periphery of the head chamber hole.

The attachment strength of this snap fastener differs depending on the direction in which it is pulled apart.

SUMMARY OF THE INVENTION

The object of the present invention is to provide a snap fastener having larger directional strength against a detaching force than that of the prior invention. More specifically, the snap fastener of the present invention possesses such a powerful directional strength that an ordinary adult cannot pull it apart with his/her fingers unless he or she tries to pull it apart in certain directions.

The snap fastener having a detachment directionality of the present invention comprises a male snap made of synthetic resin and a female snap made of synthetic resin, in which the male snap has an attachment protrusion sticking out from the center of a male base, said attachment protrusion comprising a neck and an attachment head, wherein said neck being concentric with the male base while said attachment head being eccentric from the axial center of the neck to form an engagement edge, and the female snap has a female base having a head-inserting guide hole for inserting the attachment protrusion, an attachment hole through which the attachment head passes as it elastically changes its form, and a head chamber hole encasing the attachment head, said head-inserting guide hole being concentric with the attachment hole while said head chamber hole being eccentric from the insertion center so as to correspond to the eccentricity of the attachment head of the male snap, and a stopper step is formed at least on the eccentric side of the periphery of the head chamber hole, characterized in that a means for minimizing the gap between the male and female snaps is provided.

The means for minimizing the gap between the male and female snaps as they are engaged is preferably a small protrusion established on the side of the neck part opposite the engagement edge of the male snap or a protrusion provided on the female snap. In another construction, the means for minimizing the gap between the male and female snap parts as they are engaged comprises a neck of the male snap having a diameter which is about the same as the diameter of the smallest space of the female snap and a slant part provided on the attachment head of the male snap.

Preferably, the plan view shape of the attachment head is an oval including an ellipse. It is also preferable that a through space that allows the engagement edge to form and the neck to slant is provided at the root of the neck which is on the eccentric side of the attachment head. In yet another preferred embodiment, a positioning means indicating the engagement direction of the male snap and the female snap is provided at a visible position on both the male snap and the female snap.

The present invention also includes a perforating and molding die for perforating and injection-molding a snap fastener having an asymmetrical protrusion that provides the snap fastener with a detachment directionality. This die has a perforating pin which is turnable and is used in a fastened condition at a certain perforating position.

BRIEF DESCRIPTION OF THE DRAWINGS

Examples of the present invention will now be described with reference to the accompanying drawings, in which.

DETAILED DESCRIPTION OF THE PREFERRED EMBODIMENTS

Figure 1:
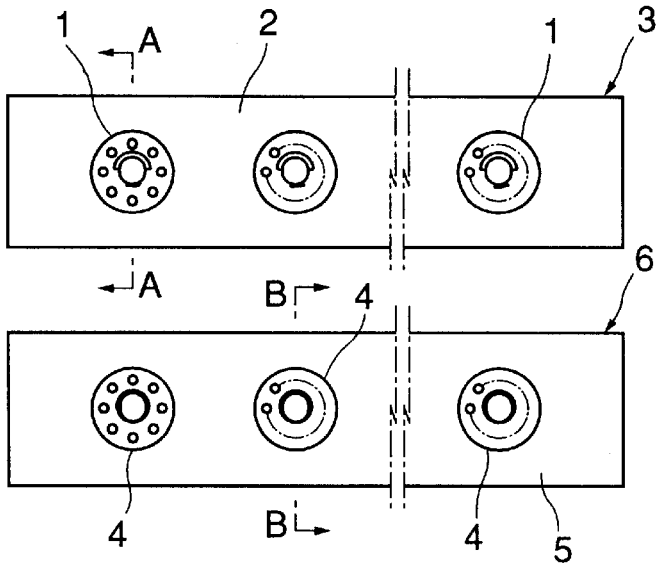
FIG. 1 is a partial schematic plan view of a snap fastener with a pair of tapes.

As shown in FIG. 1, the tape of the present invention consists of snaps on a pair of tapes, i.e., a male-side tape 3 and a female-side tape 6. The male-side tape 3 consists of several polyacetal resin male snaps 1 mould-fastened to a nylon or cotton cloth tape 2 at certain intervals using a means for injection-molding fused resin. The female-side tape 6 consists of several female snaps 4 of the same material as the male snaps 1 mould-fastened to a cloth tape 5 at the same or different intervals as the male snaps 1. The tape-mounted snap faster is actually a long item, but for the convenience of illustration, only a part of it is shown in FIG. 1.

Figure 2:
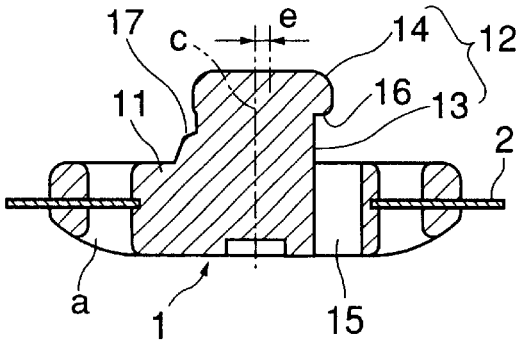
FIG. 2 is an enlarged cross sectional view of a male snap taken along line A—A of FIG. 1.

As shown in FIG. 2, the male snap 1 fastened to the cloth tape 2 is provided with an attachment protrusion 12 sticking out from the center of the male base 11. The neck 13 constituting a part of the attachment protrusion 12 is a column, and at the tip of the neck 13 an attachment head 14 having a circumference larger than that of the neck 13 is formed slightly eccentrically from the central axis (c) of the neck 13.

Figure 3:
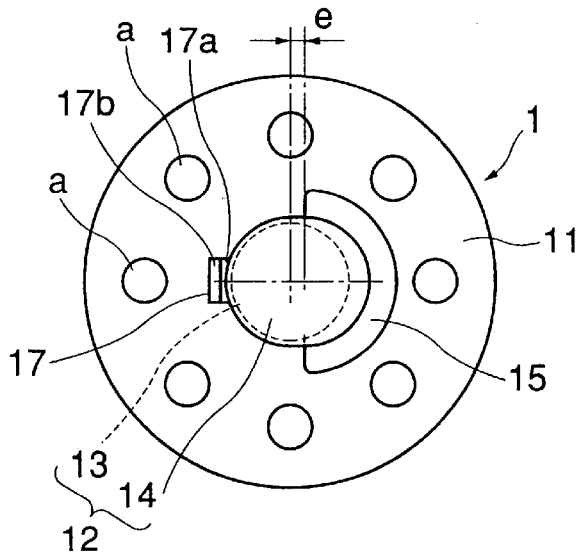
FIG. 3 is an enlarged plan view of a male snap as viewed from the attachment surface.

As shown in FIGS. 2 and 3, this attachment head 14 has an oval shape in the plan view having a distance between the foci of (e). One of the foci is aligned with the central axis (c) of the neck 13. On the periphery of the attachment head 14 an engagement edge 16 is formed in such a way that it is larger on the eccentric side. A small protrusion 17 is established on the side of the neck 13 opposite the engagement edge 16. This small protrusion 17 is trapezoidal in shape and has a bottom mildly slanting from the horizontal top 17*a* towards the male base 11.

The male base part 11 of the male snap 1 has a semicircular through space 15 on the eccentric side of the root of the neck 13. This semicircular through space 15 doubles as a mould for forming a large hook engagement edge 16 with a simple split die and as a space for allowing elastic deformation of the neck 13. This through space 15 also provides a positioning mark indicating the direction of engagement.

Figure 4:
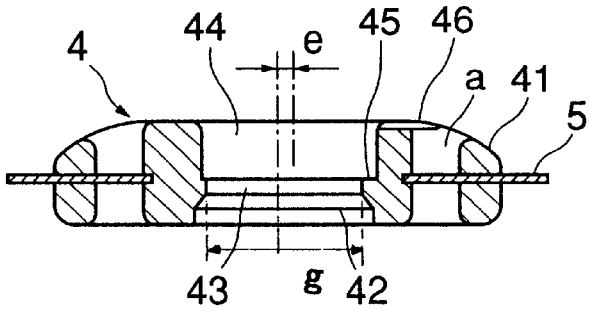
FIG. 4 is an enlarged cross sectional view of a female snap taken along line B—B of FIG. 1.
Figure 5:
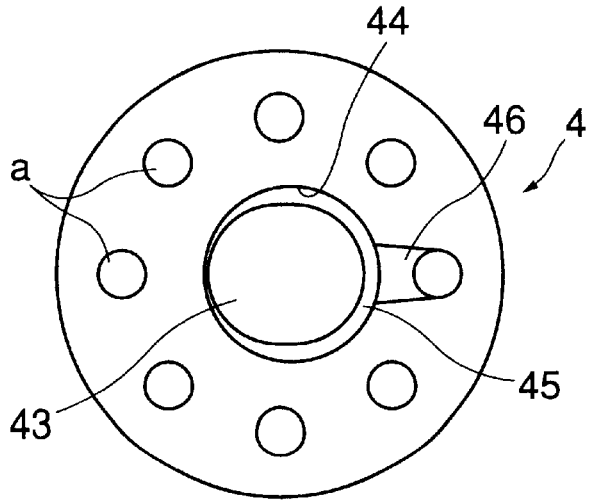
FIG. 5 is an enlarged plan view of a female snap as viewed from the side opposite the attachment surface.

As shown in FIGS. 4 and 5, the female snap 4 mould-fastened to the cloth tape 5 comprises a female base 41 on which a head-inserting guide hole 42 for inserting the attachment protrusion 12 of the male snap 1, an attachment hole 43 through which the attachment head 14 passes as it elastically changes its form, and a head chamber hole 44 encasing the attachment head 14 are established. The head-inserting guide hole 42 is concentric with the attachment hole 43. The head chamber hole 44 is formed at the position which is eccentric, i.e., apart from the inserting side center, by (e), where (e) is the distance between the foci of the oval shaped attachment head 14 of the male snap 1. Around the periphery of the bottom of the head chamber hole 44, a stopper step 45 is formed as a result of the eccentricity of the head chamber 44 with respect to the attachment hole 43 as well as by the dimensional difference between the two. On the side of the surface of the female base 41 where the stopper step 45 is formed, there is an indentation 46 that indicates the direction of engagement.

Figure 6:
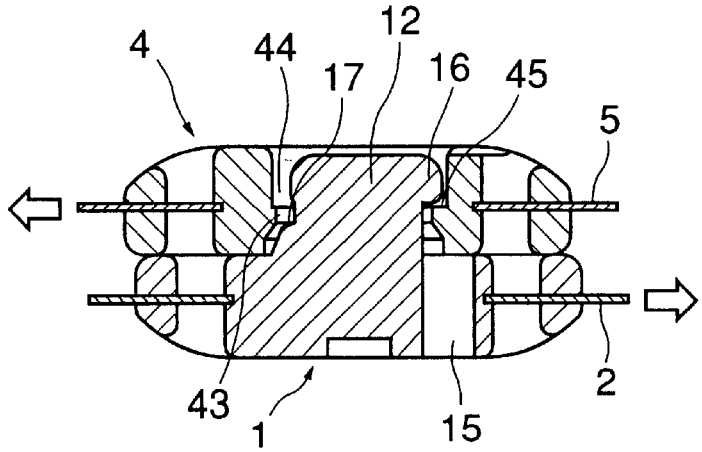
FIG. 6 is a cross sectional view showing the attached condition of a male snap and a female snap.
Figure 7:
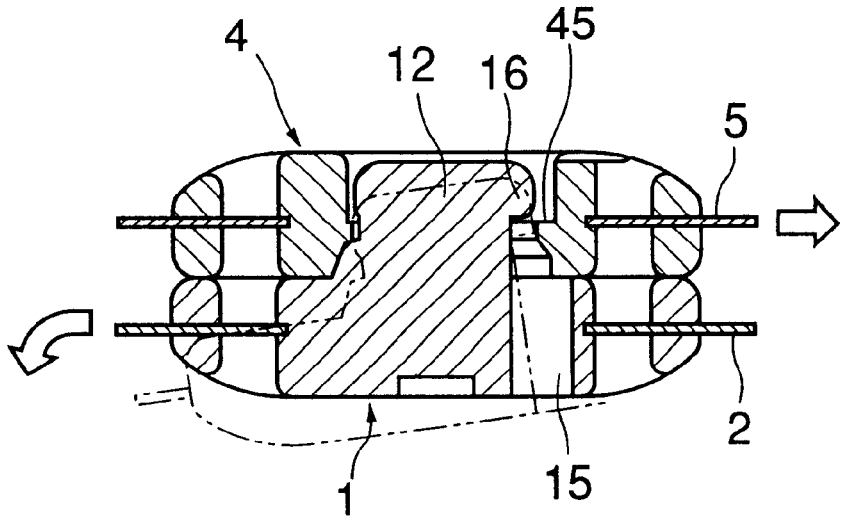
FIG. 7 is a cross sectional view showing the separating condition of a male snap and a female snap.

In the drawings, code (a) indicates pin holes formed by the pins of the molding die for the purpose of fastening the cloth tapes 2 and 5 at the molding stage. The male snap 1 and the female snap 2 are attached to each other as shown in FIG. 6, and detached from each other as shown in FIG. 7. As apparent from FIG. 5, the through space 15, which provides a positioning mark indicating the engagement direction, and the indentation 46 are aligned in the same direction. As shown in FIG. 6, the attachment protrusion 12 of the male snap 1 is pushed into the attachment hole 43 through the head-inserting guide hole 42 of the female snap 4, and the attachment head 14 fits into the head chamber hole 45 while the attachment hole 43 and the attachment head 14 are elastically deformed. When the attachment head 14 fits into the head chamber hole 44, the engagement edge 16 is stopped by the stopper step 45. In this way, the male snap 1 and the female snap 4 are attached to each other.

When the cloth tapes 2 and 5 thus attached are pulled horizontally (in the directions indicated by arrows in FIG. 6), the neck 13 of the attachment protrusion 14 of the male snap 1 moves in the direction of eccentricity within the attachment hole 43 of the female snap 4. At this time, the stopper step 45 on the wider side formed by the eccentricity is engaged by the engagement edge 16 of the attachment head 14 which has a large overhang also formed by the eccentricity. In this condition, the small protrusion 17 fills the space of the head-inserting guide 42, so the male and female snaps are firmly attached to each other without the possibility of their becoming detached inadvertently. To disengage the attachment of the male snap 1 and the female snap 2, reverse forces are applied to the cloth tape 5 as indicated by the arrows in FIG. 7. Then the neck 13 of the attachment protrusion 14 moves within the attachment hole 43 of the female snap 4 in the direction opposite that described in the above paragraph. This loosens the engagement between the stopper step 45 on the wider side of the attachment hole 43 and the engagement edge 16 of the attachment head 14. In addition, the through space 15 formed at the root of the attachment protrusion 12 prolongs the elastic deforming span of the attachment protrusion 12 in the direction of the through space. As a result, the forces acting in the directions that separate the male and female snaps make it easier for the attachment protrusion 12 to elastically deform (as shown by the imaginary lines). In this condition, the male snap 1 and the female snap 4 can be separated with just a little effort. At this time, the small protrusion 17 does not prevent separation because it is not engaged with the female snap.

In the above example, the plan view shape of the attachment head 14 is oval and the neck 13 is solid. In addition, the through space 15 is formed in the male snap 1 and the indentation 46 is formed in the female snap 4. But it is also possible to give an elliptical shape to the plan view shape of the attachment head 14 and to make the neck 13 hollow. Moreover, the indentation 46 that indicates the engagement direction can be dispensed with by using the cloth 5 as a reference for maintaining a certain direction of the male snap 1 as explained below. Even then, the action and the effect of the present invention can be achieved.

The manufacturing method and the use of the tape-mounted snap faster according to the example of the present invention as explained above are, in most part, the same as those for the conventional snap fastener (e.g. JP-Y-1-364406) that has been produced and sold.

To manufacture the snap fastener of the present invention, upper and lower dies provided with a multitude of male-snap-molds and female-snap-molds are used. Between these upper and lower dies, cloth tapes provided with positioning holes corresponding to the molds are inserted. After holes are made on the tapes, fused resin is injected into the molds.

As mentioned above, the male snap of the present invention has an attachment head 14 with a large overhang, which is the engagement edge 16. Previously, to change the directionality of detachment this type of snaps having an asymmetric protrusion 12 (for example from the longitudinal direction to the perpendicular direction of the tape), either the dies had to be changed, or the feeding direction of the tapes had to be changed. Either method required a lot of time and trouble.

Figure 14:
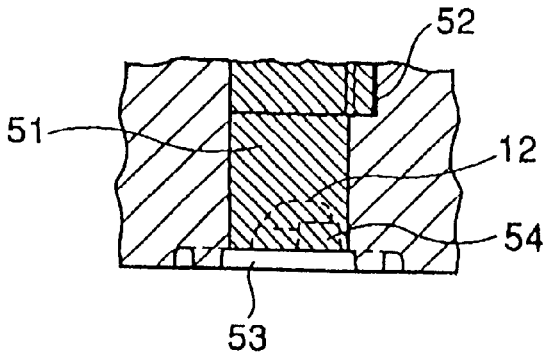
FIG. 14 is a cross sectional view of the main part of the upper die used in the present invention.
Figure 15:
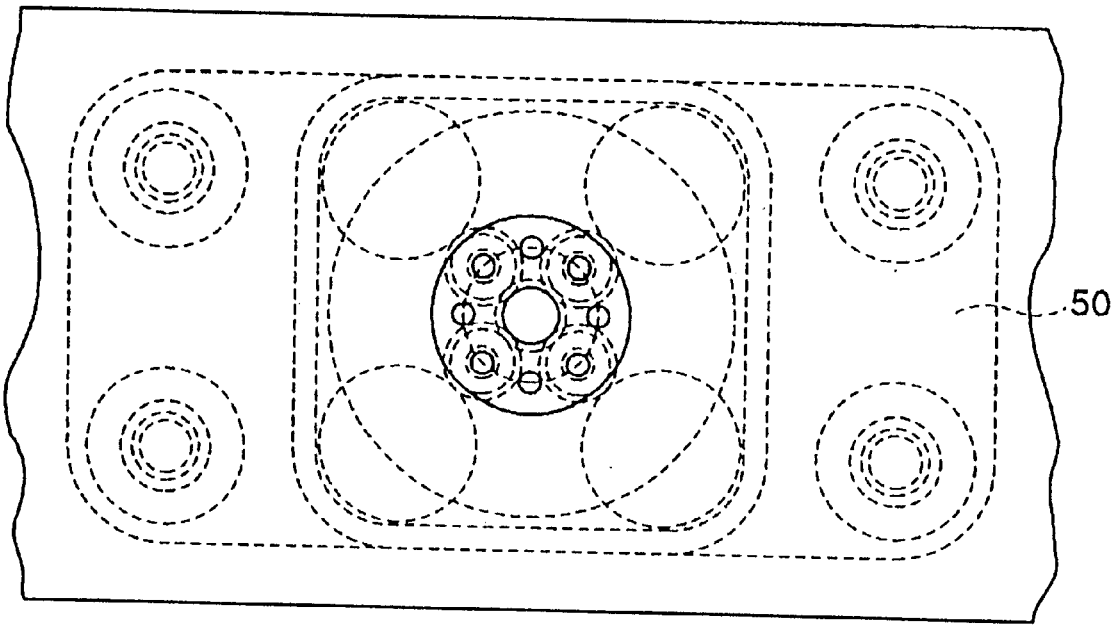
FIG. 15 is a bottom view of the upper die.

The present invention has solved this problem by using the dies as shown in FIGS. 14 and 15 that allow the positions of hole making and injection molding to be varied with ease. FIG. 14 is a side view of the upper die used in the present invention, and FIG. 15 is a bottom view of the same. According to die 50 of the present invention, the perforating pin 51 is turnable either by hand or by a motor. The perforating positions are fixed by a rotation-preventing part 52 shown in FIG. 14. In FIG. 14, numeral 53 is a molding chamber for a male snap and 54 is a support table for forming the engagement edge 16. This support table 54 sticks out of the lower die through the through space 15.

Figure 8:
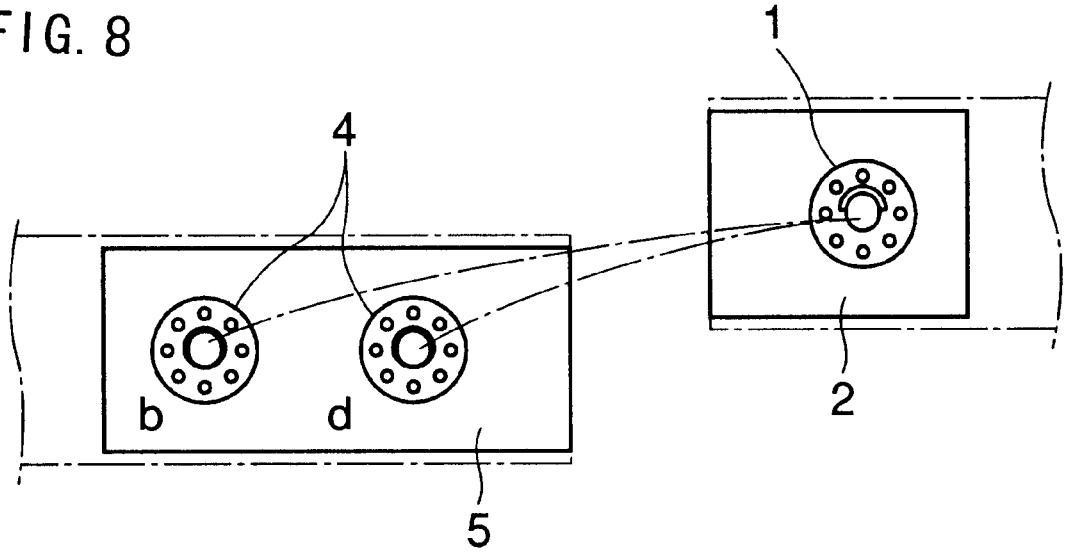
FIG. 8 is an explanatory drawing showing an example of using a snap fastener with a pair of tapes.
Figure 9:
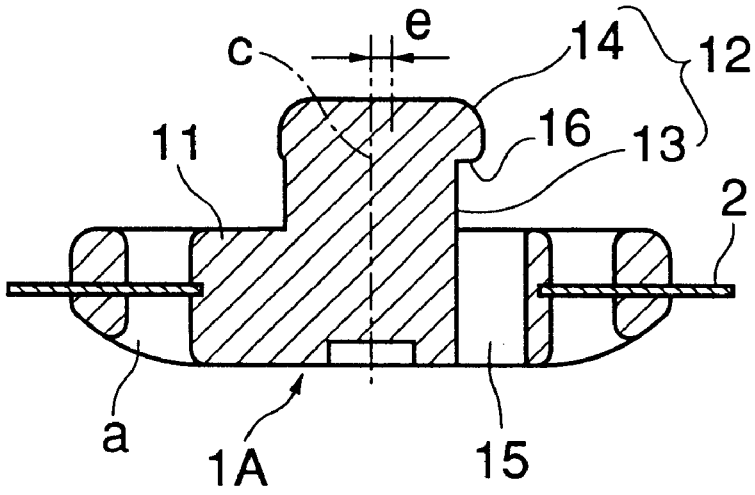
FIG. 9 is an enlarged cross sectional view of a male snap of the second example taken along line A—A of FIG. 1.
Figure 10:
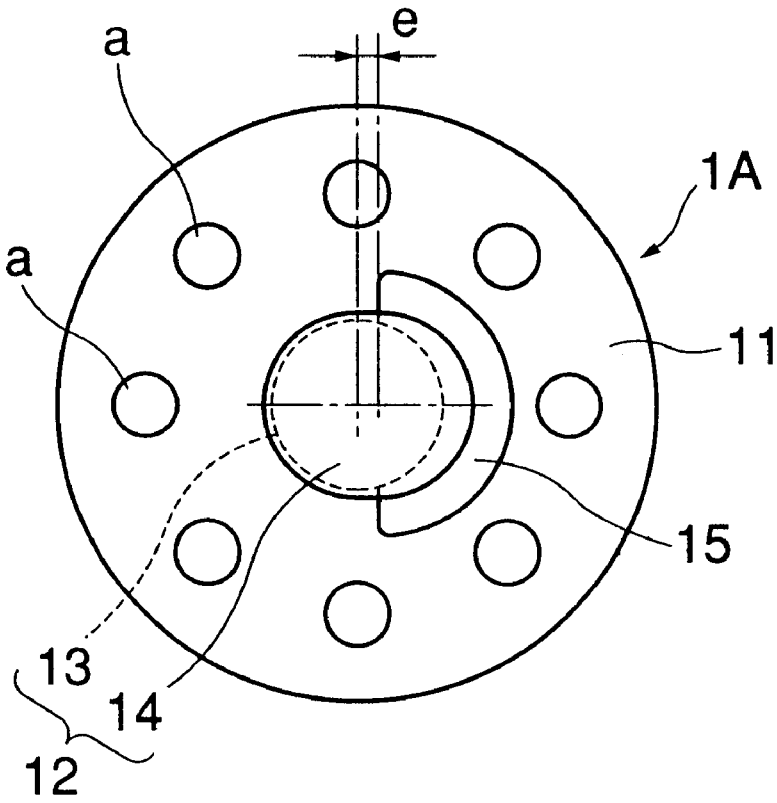
FIG. 10 is an enlarged plan view of a male snap of the second example as viewed from the attachment surface of the male snap.
Figure 11:
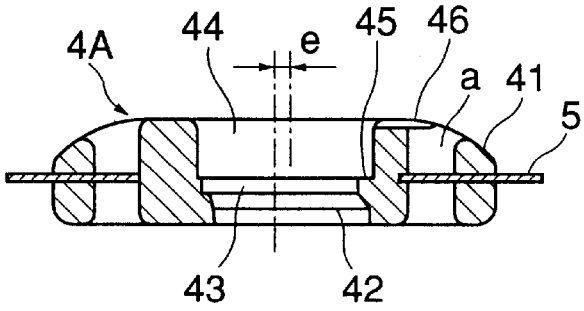
FIG. 11 is an enlarged cross sectional view of a female snap of the second example taken along line B—B of FIG. 1.
Figure 12:
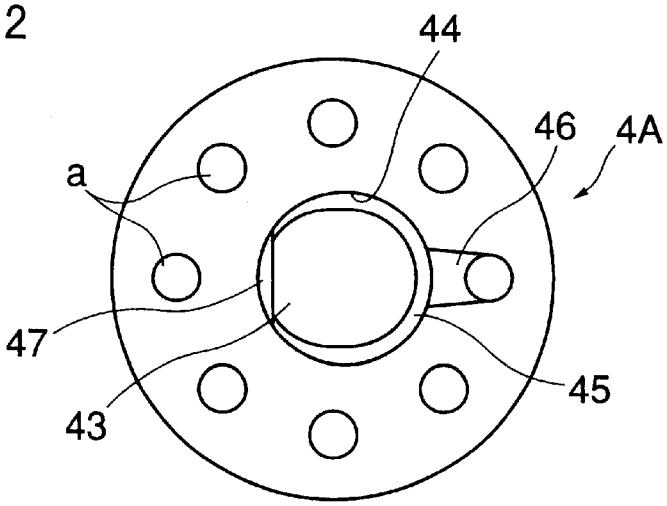
FIG. 12 is an enlarged plan view of a female snap of the second example as viewed from the side opposite the attachment surface.

The snap fastener of the present invention can be used in a variety of ways. For example, the male snap 1 and the female snap 2 can be combined so that there are the same number of each. Or, as shown in FIG. 8, in order to take advantage of the snap fastener's adjusting unction, the cloth tape 2 can be cut so that it is just long enough for one male snap 1 and sewn to one end of the opening of the object, and the cloth tape 5 can be cut so that it is just long enough for two or three female snaps 4 (two in the drawing) and sewn to the other end of the opening of the object. In this configuration, the male snap 1 is used to selectively- engage (b) or (d) of the female snap 2. Or, in order to conform to contact surfaces that are not flat, different numbers of male and female fasteners or those with different intervals can be combined and sewn.

FIGS. 9 to 13 show a second example of the present invention. The male snap 1A is the same as the male snap 1 of the first example except that there is no small protrusion 17. Therefore, the same numerals are used for parts having the same functions to avoid repeating the same explanation.

Figure 13:
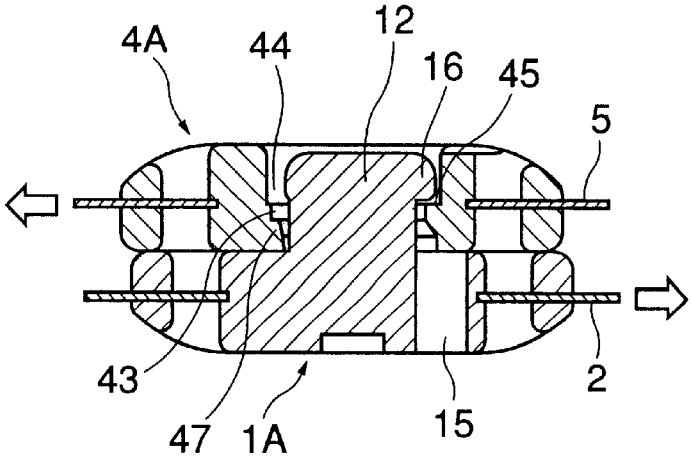
FIG. 13 is a cross sectional view showing the attached condition of a male part and a female snap of the second example.

The female part 4A is the same as the female snap 4 of the first example except that there is a protrusion 47 sticking out so as to partially fill the attachment hole 43. Therefore, the same numerals are used for parts having the same functions to avoid repeating the same explanation. In other words, while there is a protrusion on the male snap in the first example, there is a protrusion on the female snap in the second example. FIG. 13 shows the attached condition of the male snap 1A and the female snap 4A of the second example as configured above. According to this drawing, the through space 15, which provides a positioning mark indicating the engagement direction, and the indentation 46 are aligned in the same direction. In this condition, the attachment protrusion 12 of the male snap 1A is pushed into the attachment hole 43 through the head-inserting guide hole 42 of the female snap 4A, and the attachment head 14 is fitted into the head chamber hole 45 while the attachment hole 43 and the attachment head 14 are elastically deformed. When the attachment head 14 is fitted into the head chamber hole 45, the engagement edge 16 is stopped by the stopper step 45. In this way, the male snap 1A and the female snap 4A are attached to each other.

Figure 16:
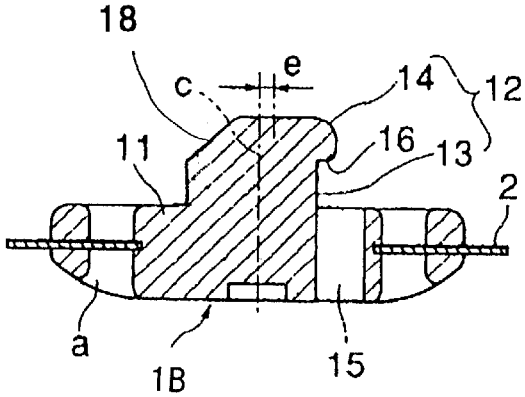
FIG. 16 is an enlarged cross sectional view of a male snap of the third example taken along line A—A of FIG. 1.
Figure 17:
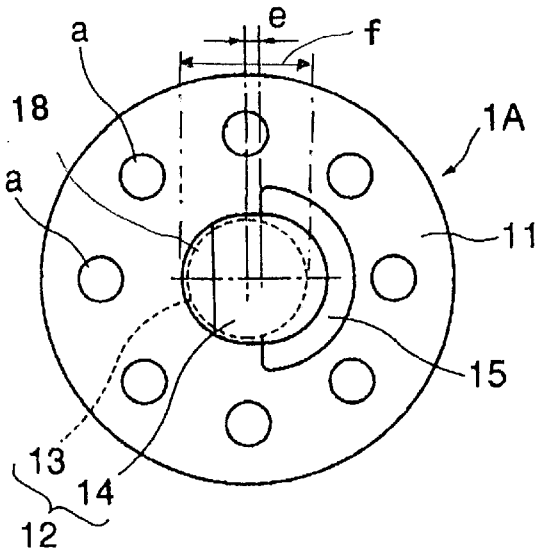
FIG. 17 is an enlarged plan view of a male snap of the second example as viewed from the attachment surface.
Figure 18:
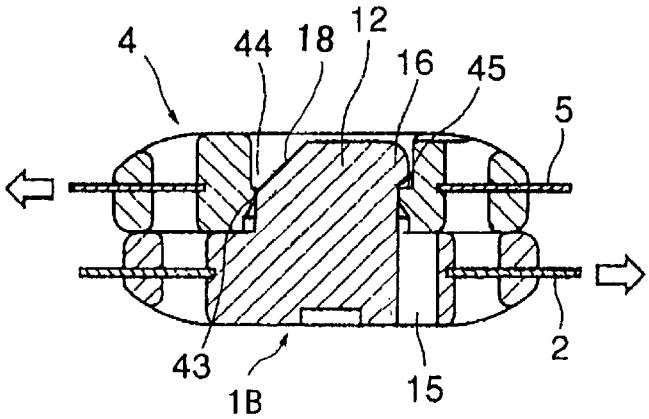
FIG. 18 is a cross sectional view showing the attached condition of a male snap and a female snap of the third example.

When the cloth tapes 2 and 5 thus attached are pulled horizontally (in the directions indicated by the arrows in FIG. 13), the neck 13 of the attachment protrusion 14 of the male snap 1A moves in the direction of eccentricity within the attachment hole 43 of the female snap 4A. At this time, the stopper step 45 on the wider side formed by the eccentricity is engaged by the engagement edge 16 of the attachment head 14 which has a large overhang also formed by the eccentricity. In this condition, the protrusion 47 fills the space of the head-inserting guide 42, so the male and female snaps are firmly attached to each other without the possibility of their becoming detached inadvertently. FIGS. 16 to 18 show a third example of the present invention. The male snap 1B is different from the male snap 1 of the first example in the following respects. First, there is no small protrusion 17. Second, the side of the attachment head 14 opposite the engagement edge 16 is cut off diagonally to form a slant 18. And third, the diameter (f) of the neck 13 (FIG. 17) is about the same as the smallest diameter part of the attachment hole 43 of the female snap, i.e., the diameter (g) (FIG. 4) of the part formed by the stopper step 45. As such, in the attached condition, the smallest diameter part of the female snap makes firm contact with the neck 13 as shown in FIG. 18.

In this example, the male snap has a slant 18, so the engagement of the male and female parts is not difficult to achieve despite the presence of the engagement edge 16 which sticks out. Moreover, the same action as in the first and second examples gives this example a detachment directionality.

MERITORIOUS EFFECTS

According to the snap fastener with tapes of the present invention, the attachment protrusion 12 of the male snap 1 is pushed into the attachment hole 43 through the head-inserting guide hole 42 of the female snap 4, and the attachment head 14 is fitted into the head chamber hole 45 while the attachment hole 43 and the attachment head 14 are elastically deformed. When the attachment head 14 is fitted into the head chamber hole 45, the engagement edge 16 is stopped by the stopper step 45. In this way, the male snap and the female snap are attached to each other. When the male snap and the female snap are pulled horizontally, the neck of the attachment protrusion of the male snap moves in the eccentric direction within the attachment hole of the female snap. At this time, the stopper step 45 on the wider side formed by the eccentricity is engaged by the engagement edge 16 of the attachment head 14. In this condition, the male and female snaps are firmly attached to each other without the possibility of their becoming detached inadvertently.

By making the plan view shape of the attachment head 14 oval including an ellipse and by forming the through space 15 that allows the engagement edge 16 to form and the neck 13 to slant at the root of the neck 13 which is on the eccentric side of the attachment head 14, it is possible to provide the engagement edge 16 with a large hook formed by the eccentricity and the dimensional difference, using a simple split die. This arrangement makes the attachment of the male and female snaps firmer and stronger, and prevents inadvertent detachment.

To release the attachment of the male snap 1 and the female snap 4, forces acting in the reverse directions and in the separating directions are applied. Then the neck 13 of the attachment protrusion 14 moves within the attachment hole 43 of the female snap 4 in the direction opposite that described in the above paragraph. This loosens the engagement between the stopper step 45 on the wider side of the attachment hole 43 and the engagement edge 16 of the attachment head 14, so that the male snap 1 and the female snap 4 can be separated with just a little effort.

In this case, the through space 15 prolongs the elastic deforming span of the attachment protrusion 12 in the direction of the through space. As a result, the forces acting in the directions that separate the male and female snaps make it easier for the attachment protrusion 12 to elastically deform, further facilitating the separation of the male snap 1 and the female snap 4.

The above effects are also obtained by the prior application (JP-A-10-33210 (1998)), but in the first example of the present invention, the small protrusion 17 is added to the side of the neck 13 opposite the engagement edge 16, further strengthening the directional strength against detachment. In the second example, the protrusion 47 is established on the female snap.

According to the third example, unlike the products of the first and second examples, it is not necessary to form a small protrusion, so it is easy to mould the parts. In the first and second examples, when the male and female parts are joined, the small protrusion 17 or 47 advances, stops and then advances again, resulting in a two-step advancement. But in this example, the male and female parts can be joined in one-step advancement. Moreover, the slant part 18 of the present invention functions as a mark indicating directionality.

As explained above, the present invention solves the problem relating to the engagement of male and female snaps made of resin while taking advantage of their characteristics. The present invention also solves the problem relating to hooks and loops. The present invention makes it possible to provide inexpensive snap fasteners with tapes featuring optimum functions as fasteners for under garments, e.g., body suits, brassieres, corsets, slips, and outer garments, e.g., dress suits, one-piece suits, blouse, etc., as well as diapers.

What is claimed is:

1. A snap fastener having a detachment directionality, comprising:

a male snap made of synthetic resin, said male snap having an attachment protrusion sticking out from the center of a male base, said attachment protrusion comprising a neck and an attachment head, wherein said neck being concentric with the male base while said attachment head being eccentric from the axial center of the neck to form an engagement edge, a female snap made of synthetic resin, said female snap having a female base having a head-inserting guide hole for inserting the attachment protrusion, an attachment hole through which the attachment head passes as it elastically changes its form, a head chamber hole encasing the attachment head, said head-inserting guide hole being concentric with the attachment hole while said head chamber hole being eccentric from the insertion center so as to correspond to the eccentricity of the attachment head of the male snap, and a stopper step formed at least on the eccentric side of the periphery of the head chamber hole, means for minimizing the gap between the male and female parts, and wherein the means for minimizing the gap between the male and female snaps as they are engaged is a small protrusion provided on the side of the neck opposite the engagement edge of the male snap.

2. A snap fastener having a detachment directionality, comprising:

a male snap made of synthetic resin, said male snap having an attachment protrusion sticking out from the center of a male base, said attachment protrusion comprising a neck and an attachment head, wherein said neck being concentric with the male base while said attachment head being eccentric from the axial center of the neck to form an engagement edge, a female snap made of synthetic resin, said female snap having a female base having a head-inserting guide hole for inserting the attachment protrusion, an attachment hole through which the attachment head passes as it elastically changes its form, a head chamber hole encasing the attachment head, said head-inserting guide hole being concentric with the attachment hole while said head chamber hole being eccentric from the insertion center so as to correspond to the eccentricity of the attachment head of the male snap, and a stopper step formed at least on the eccentric side of the periphery of the head chamber hole, means for minimizing the gap between the male and female parts, and wherein the means for minimizing the gap between the male and female snaps as they are engaged comprises a neck of the male snap having a diameter which is about the same as the diameter of the smallest space of the female snap and a slant part provided on the attachment head of the male snap.

3. A snap fastener having a detachment directionality, comprising:

a male snap made of synthetic resin, said male snap having an attachment protrusion sticking out from the center of a male base, said attachment protrusion comprising a neck and an attachment head, wherein said neck being concentric with the male base while said attachment head being eccentric from the axial center of the neck to form an engagement edge, a female snap made of synthetic resin, said female snap having a female base having a head-inserting guide hole for inserting the attachment protrusion, an attachment hole through which the attachment head passes as it elastically changes its form, a head chamber hole encasing the attachment head, said head-inserting guide hole being concentric with the attachment hole while said head chamber hole being eccentric from the insertion center so as to correspond to the eccentricity of the attachment head of the male snap, and a stopper step formed at least on the eccentric side of the periphery of the head chamber hole, means for minimizing the gap between the male and female parts, and wherein a through space that allows the engagement edge to form and the neck to slant is provided at the root of the neck which is on the eccentric side of the attachment head.

* * * * *